US009512553B2

(12) United States Patent
Choi

(10) Patent No.: US 9,512,553 B2
(45) Date of Patent: Dec. 6, 2016

(54) WASHING MACHINE HAVING UPPER COVER

(71) Applicant: SAMSUNG ELECTRONICS CO., LTD., Suwon-si (KR)

(72) Inventor: Han Kyu Choi, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/900,886

(22) Filed: May 23, 2013

(65) Prior Publication Data

US 2013/0320824 A1 Dec. 5, 2013

(30) Foreign Application Priority Data

May 31, 2012 (KR) ..... 10-2012-0058901

(51) Int. Cl.
*D06F 39/12* (2006.01)

(52) U.S. Cl.
CPC ..... *D06F 39/12* (2013.01)

(58) Field of Classification Search
CPC ..... A47B 77/00; A47B 96/18; B29C 45/17; D06F 39/12; D06F 39/14
USPC ..... 312/228, 257.1; 68/3 R, 139
See application file for complete search history.

(56) References Cited

U.S. PATENT DOCUMENTS

2005/0012439 A1* 1/2005 Kim et al. ..... 312/228
2005/0178163 A1* 8/2005 Kim et al. ..... 68/3 R
2009/0153004 A1* 6/2009 Han et al. ..... 312/228

FOREIGN PATENT DOCUMENTS

| | | |
|---|---|---|
| CN | 1952248 | 4/2007 |
| CN | 101722617 | 6/2010 |
| DE | 42 40 888 A1 | 6/1994 |
| EP | 0 680 712 A1 | 11/1995 |
| EP | 2 181 830 A1 | 5/2010 |

OTHER PUBLICATIONS

European Search Report Issued Oct. 2, 2013 in corresponding European Application No. 13169728.6.
Chinese Office Action dated Mar. 24, 2016 in Chinese Patent Application No. 201310209447.5.
European Decision on Grant dated Jun. 22, 2016 in European Patent Application No. 13169728.6.

* cited by examiner

*Primary Examiner* — James O Hansen
(74) *Attorney, Agent, or Firm* — Staas & Halsey LLP

(57) ABSTRACT

An upper cover of a washing machine having an improved structure in which the upper cover may be manufactured in a simple process. The washing machine includes: a main body; and an upper cover configured to cover an upper part of the main body, wherein the upper cover includes: a cover plate formed in a rectangular shape; and a cover frame formed of a material different from a material for the cover plate and coupled to the cover plate along a circumference of the cover plate, and the cover frame includes: at least one first support part configured to support an upper side of the cover plate; and at least one second support part configured to support a lower side of the cover plate.

12 Claims, 10 Drawing Sheets

WASHING MACHINE HAVING UPPER COVER

CROSS-REFERENCE TO RELATED APPLICATIONS

This application claims the priority benefit of Korean Patent Application No. 10-2012-0058901, filed on May 31, 2012 in the Korean Intellectual Property Office, the disclosure of which is incorporated herein by reference.

BACKGROUND

1. Field

Embodiments of the present disclosure relate to a structure of an upper cover that covers an upper part of a washing machine.

2. Description of the Related Art

A drum washing machine as a machine that washes clothes using power, generally includes a tub in which washing water is stored, a drum rotatably installed in the tub, and a driving motor to rotate the drum. When the drum is rotated in a state in which laundry and detergent water are put into the drum, laundry is in friction with the drum and detergent water so that dirt may be removed from laundry.

In general, the drum washing machine includes a main body that forms a space in which the drum, the driving motor, and the like may be accommodated, and an upper cover that covers an upper part of the main body that is open.

The upper cover is generally manufactured by individually making a rectangular plate formed of wood and a molded material formed of plastic and coupled to a circumference of the rectangular plate and then by integrating the rectangular plate and the molded material by stapling or using an adhesive. However, a working process of the upper cover is complicated, and an excessive working time is required.

SUMMARY

Therefore, it is an aspect of the present disclosure to provide an upper cover of a washing machine having an improved structure in which the upper cover may be manufactured in a simple process.

It is another aspect of the present disclosure to provide an upper cover of a washing machine having an improved structure in which the upper cover may be prevented from being bent or twisted.

Additional aspects of the disclosure will be set forth in part in the description which follows and, in part, will be obvious from the description, or may be learned by practice of the disclosure.

In accordance with one aspect of the present disclosure, there is provided a washing machine including: a main body; and an upper cover configured to cover an upper part of the main body, wherein the upper cover includes: a cover plate formed in a rectangular shape; and a cover frame formed of a material different from a material for the cover plate and coupled to the cover plate along a circumference of the cover plate. The cover frame includes: at least one first support part configured to support an upper side of the cover plate; and at least one second support part configured to support a lower side of the cover plate.

The cover plate may be inserted when the cover frame is injection molded and may be formed integrally with the cover frame.

The cover frame may include at least one third support part configured to support a circumferential side of the cover plate.

The at least one third support part may be configured in such a way that at least two third support parts are spaced apart from each other by a predetermined gap along an inner circumference of the cover frame.

The cover frame may further include a contact avoidance part that is disposed between the at least one third support part and does not contact the circumferential side of the cover plate.

The contact avoidance part may be configured in such a way that at least two contact avoidance parts are spaced apart from each other by a predetermined gap along the inner circumference of the cover frame.

The upper cover may further include a damping member inserted between the cover frame and the cover plate.

The damping member may be coupled to the cover plate along the circumference of the cover plate and may be inserted together with the cover plate when the cover frame is injection molded.

The damping member may include: a first contact part of which an outer side contacts the first support part and an inner side contacts the upper side of the cover plate; and a second contact par, of which an outer side contacts the second support part and an inner side contacts the lower side of the cover plate.

The damping member may include a connector of which an inner side contacts the circumferential side of the cover plate and which connects the first contact part and the second contact part.

The connector may further include a through hole formed by penetrating at least one portion of an inner side of the connector so as to absorb and alleviate force caused by contraction of the cover frame when the cover frame is injection molded.

In accordance with another aspect of the present disclosure, there is provided a washing machine including: a main body of which an upper part is open; and a cover member coupled to the upper part of the main body, wherein the cover member includes: a cover plate formed in a rectangular shape; and a cover frame coupled to the cover plate along a circumference of the cover plate. The cover frame includes: a plurality of support ribs configured to extend from an inner side of the cover frame facing a circumferential side of the cover plate toward the circumferential side and contact the circumferential side; and a plurality of contact avoidance sides disposed between two adjacent support ribs among the plurality of support ribs and configured not to contact the circumferential side of the cover plate.

The plurality of support ribs may include: a first contact side that contacts the circumferential side; and a second contact side that contacts a lower side of the cover plate connected to the circumferential side.

The support ribs may be configured in such a way that at least two support ribs are spaced apart from each other by a predetermined gap along an inner side of the cover frame.

The washing machine may further include a strength reinforcement rib that connects the inner side of the cover frame and the support ribs to reinforce strength of the support ribs.

The cover plate may be inserted when the cover frame is injection molded.

In accordance with still another aspect of the present disclosure, there is provided a washing machine including: a main body of which an upper part is open; and a cover member coupled to the upper part of the main body, wherein the cover member includes: a cover frame formed in a rectangular shape; a cover plate inserted when the cover frame is injection molded and coupled to the cover frame along an inner circumference of the cover frame; and a damping member inserted between the cover frame and the cover plate and configured to absorb and alleviate force caused by contraction of the cover frame when the cover frame is injection molded.

The damping member may be coupled to the cover plate along a circumference of the cover plate and may be inserted together with the cover plate when the cover frame is injection molded.

The damping member may further include a through hole formed by penetrating at least one portion of an inner side of the damping member.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
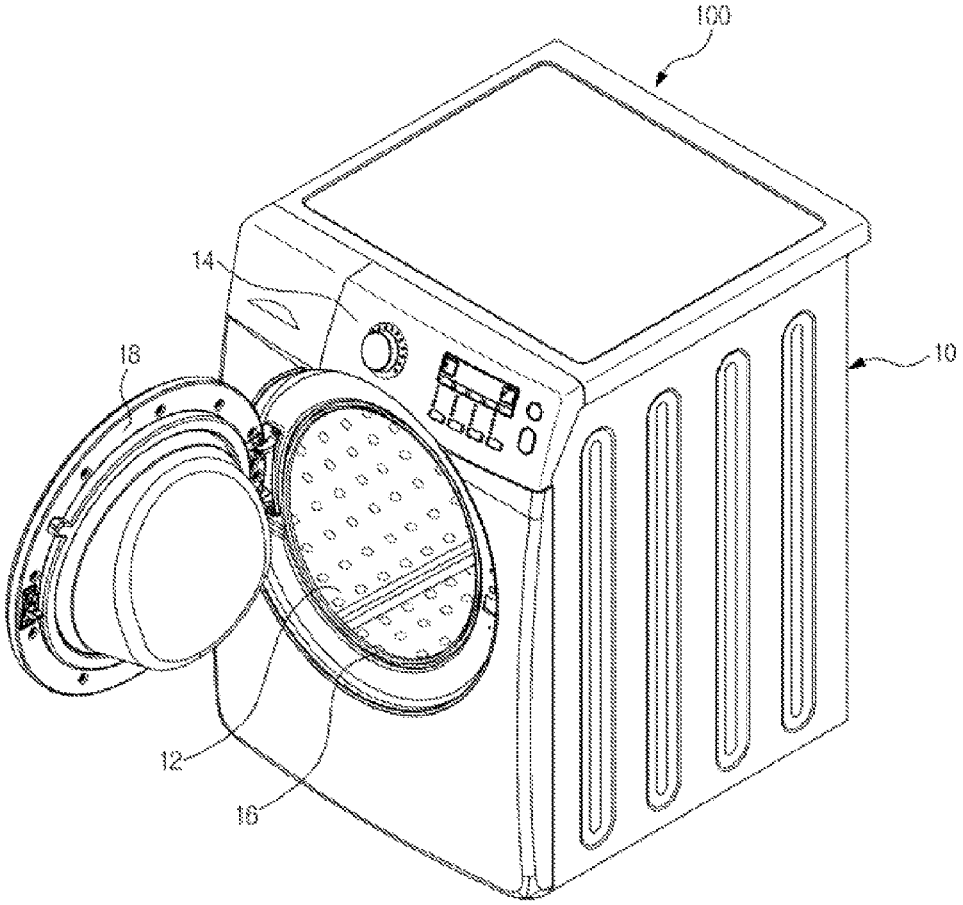
FIG. 1 is a perspective view illustrating the exterior of a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a perspective view illustrating the exterior of a washing machine according to an embodiment of the present disclosure.

As illustrated in FIG. 1, the washing machine includes a main body 10 that forms the exterior, a tub (not shown) which is installed in the main body 10 and in which washing water is stored, and a drum 12 that is rotatably disposed in the tub so as to wash laundry. A control panel assembly 14 is disposed at an upper part of a front side of the main body 10 so that a user may control an operation of the washing machine. A laundry port 16 through which laundry may be put into the drum 12 is formed at the front side of the main body 10, and a door 18 is installed to open/close the laundry port 16.

An upper cover 100 is coupled to an upper part of the main body 10.

Figure 2:
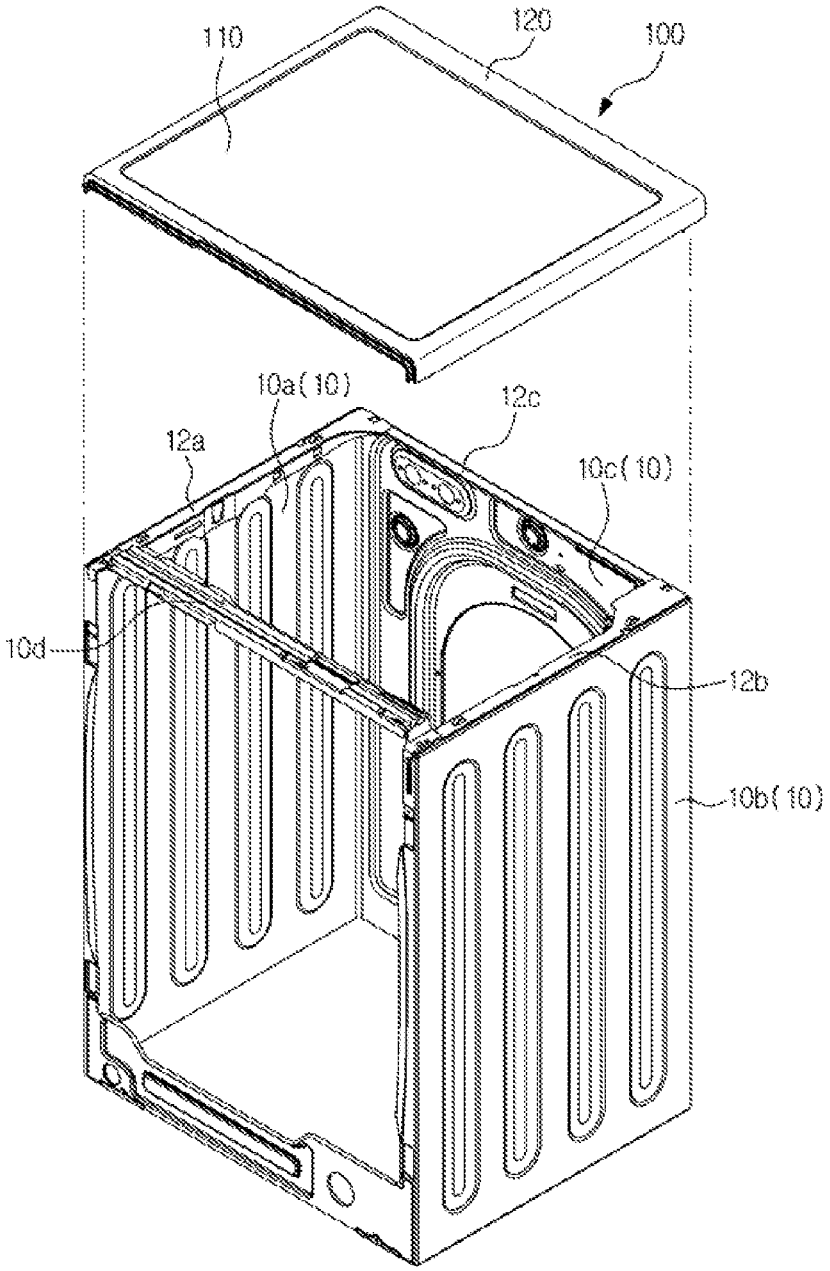
FIG. 2 is an exploded perspective view illustrating a combination relationship between a main body and an upper cover of the washing machine illustrated in FIG. 1.

FIG. 2 is an exploded perspective view illustrating a combination relationship between the main body 10 and the upper cover 100 of the washing machine illustrated in FIG. 1.

As illustrated in FIG. 2, the main body 10 includes a plurality of frames 10*a*, 10*b*, and 10*c* that form a space in which various components may be accommodated. The plurality of frames 10*a*, 10*b*, and 10*c* include side frames 10*a* and 10*b* that form right and left sides of the main body 10 and a rear frame 10*c* that forms a rear side of the main body 10 and connects the side frames 10*a* and 10*b*. A support frame 10*d* is disposed on upper parts of the side frames 10*a* and 10*b*. One end of the support frame 10*d* is coupled to the left frame 10*a*, and the other end thereof is coupled to the right frame 10*b*.

A first fixing frame 12*a* and a second fixing frame 12*b* are disposed on top surfaces of the left frame 10*a* and the right frame 10*b*. The first fixing frame 12*a* and the second fixing frame 12*b* are bent and extend toward an inner side of the main body 10 in a direction in which the first fixing frame 12*a* and the second fixing frame 12*b* face each other. A third fixing frame 12*c* is disposed on a top surface of the rear frame 10*c* and is bent and extends toward a front side of the main body 10.

The upper cover 100 is coupled to and fixed to upper parts of the plurality of frames 10*a*, 10*b*, and 10*c* and the support frame 10*d*. The upper cover 100 in a state in which the upper cover 100 is mounted and supported on the support frame 10*d* and the first through third fixing frames 12*a*, 12*b*, and 12*c*, is fixed to the support frame 10*d* and the first through third fixing frames 12*a*, 12*b*, and 12*c* using a fixing member, such as a screw, and protects various components in the main body 10 not to be exposed to the outside.

Hereinafter, a structure of the upper cover 100 according to an embodiment of the present disclosure will be described in more detail.

Figure 3:
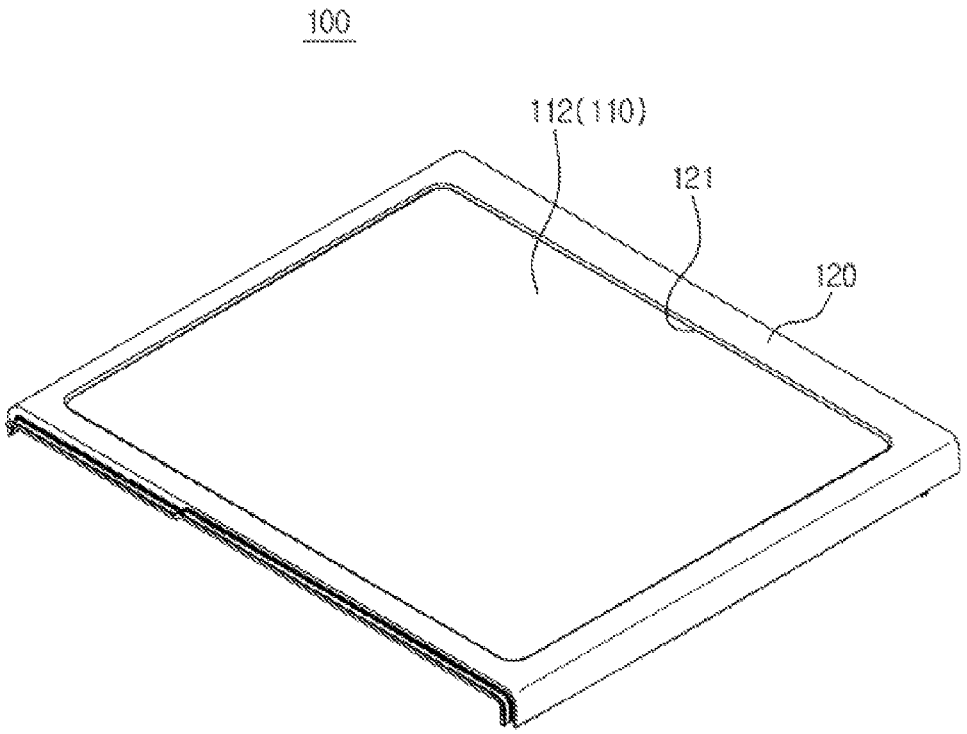
FIG. 3 is a perspective view of an upper cover according to an embodiment of the present disclosure.
Figure 4:
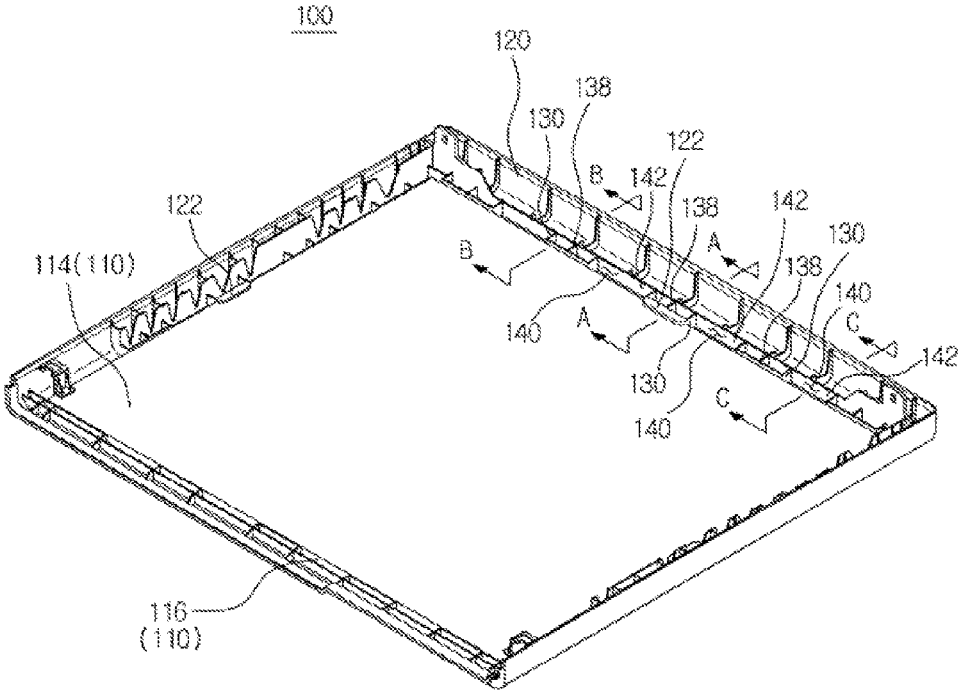
FIG. 4 is a rear perspective view of the upper cover illustrated in FIG. 3.
Figure 5:
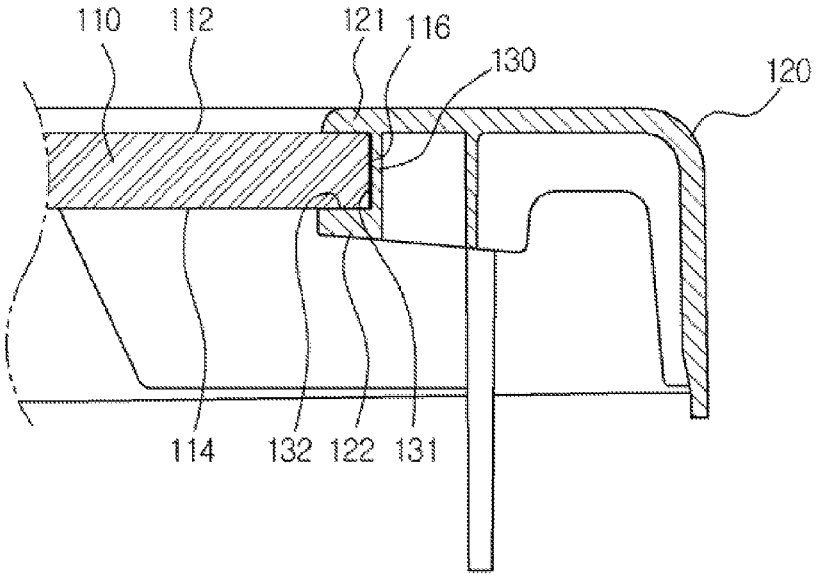
FIG. 5 is a cross-sectional view taken along line A-A of FIG. 4.
Figure 6:
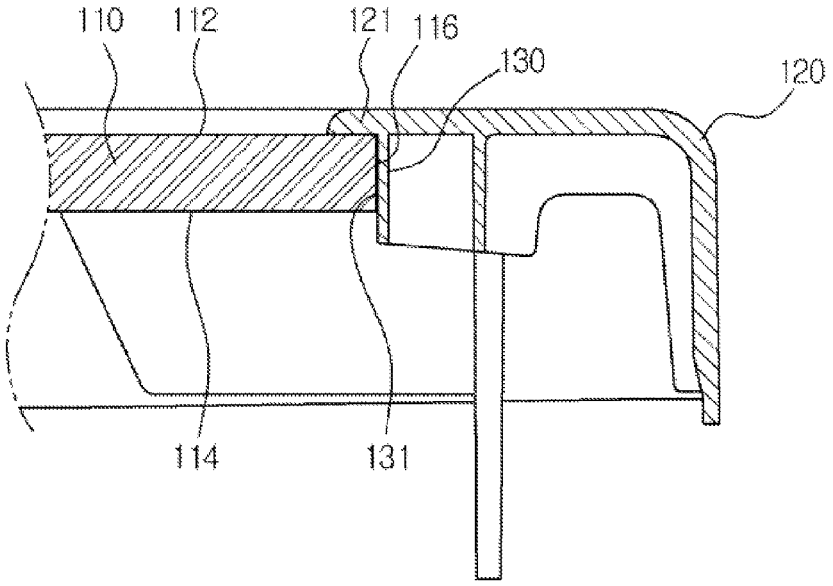
FIG. 6 is a cross-sectional view taken along line B-B of FIG. 4.
Figure 7:
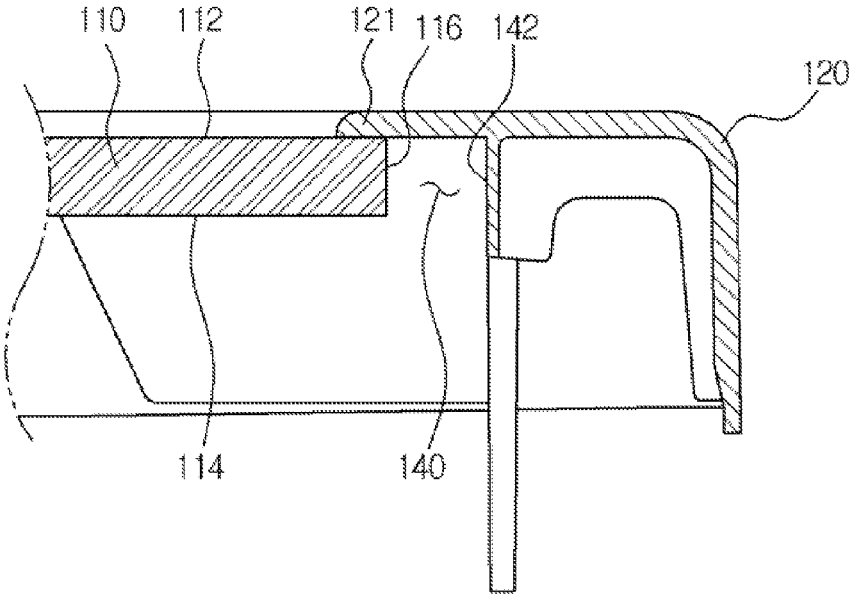
FIG. 7 is a cross-sectional view taken along line C-C of FIG. 4.

FIG. 3 is a perspective view of the upper cover 100 according to an embodiment of the present disclosure, FIG. 4 is a rear perspective view of the upper cover 100 illustrated in FIG. 3, FIG. 5 is a cross-sectional view taken along line A-A of FIG. 4, FIG. 6 is a cross-sectional view taken along line B-B of FIG. 4, and FIG. 7 is a cross-sectional view taken along line C-C of FIG. 4.

As illustrated in FIGS. 3 through 7, the upper cover 100 includes a cover plate 110 formed in a rectangular shape and a cover frame 120 that is coupled to the cover plate 110 along a circumference of the cover plate 110.

The cover plate 110 is provided as an approximately rectangular plate having an upper side 112, a lower side 114, and a circumferential side 116 that connects the upper side 112 and the lower side 114. The cover plate 110 may be formed of glued laminated wood, compression wood, or synthetic wood so as to have a predetermined strength with light weight.

The cover frame 120 includes at least one first support part 121 that supports the upper side 112 of the cover plate 110, at least one second support part 122 that supports the lower side 114 of the cover plate 110, and at least one support rib 130 that supports the circumferential side 116 of the cover plate 110.

The support rib 130 extends from an inner side of the cover frame 120 that faces the circumferential side 116 of the cover plate 110, toward the circumferential side 116 to a predetermined length, and a first contact side 131 is provided at one end of the support rib 130 and contacts the circumferential side 116.

The second support part 122 extends from one end of the support rib 130 to a predetermined width, and a second contact side 132 is provided at one side of the second support part 122 and contacts the lower side 114 of the cover plate 110.

At least two support ribs 130 and at least two second support parts 122 may be spaced apart from each other by a predetermined gap along the inner side of the cover frame 120 that surrounds the circumference of the cover plate 110. The number of support ribs 130 and the number of second support parts 122 may be changed according to design specifications of the upper cover 100. For example, when a high strength of the upper cover 100 is required and thus the thickness of the cover plate 110 increases and the weight of the cover plate 110 increases, the number of support ribs 130 disposed along the inner side of the cover frame 120 and the number of second support parts 122 that extend from one end of the support rib 130 may be increased. Of course, the width of the support rib 130 or a length at which the second support part 122 extends may be increased so that a contact area with the cover plate 110 may be increased.

A strength reinforcement rib 138 may be further provided between the support rib 130 and the cover frame 120. The strength reinforcement rib 138 connects the support rib 130 and the inner side of the cover frame 120, thereby reinforcing the strength of the cover frame 120.

Also, the cover frame 120 includes at least one contact avoidance part 140 that does not contact the circumferential side 116 of the cover plate 110.

The contact avoidance part 140 includes a contact avoidance side 142 that is formed between two adjacent support ribs 130. The contact avoidance part 140 prevents the cover frame 120 from fully contacting the whole circumferential side 116 of the cover plate 110. The reason why the contact avoidance part 140 is formed between the cover plate 110 and the cover frame 120 is to alleviate force applied to the cover plate 110 due to contraction of the cover frame 120 when the cover frame 120 is injection molded.

The cover plate 110 and the cover frame 120 may be manufactured using insert injection molding. That is, when the cover frame 120 is injection molded, the cover plate 110 is fixed to a mold for injection molding the cover frame 120, and a resin as a material for the cover frame 120 is injected into the mold and then is hardened, thereby manufacturing the cover plate 110 and the cover frame 120 integrally with each other.

When the resin as the material for the cover frame 120 is injected into the mold and is hardened, there may be a difference between contraction quantities of the cover plate 110 formed of wood and the cover frame 120 formed of resin. Since the contraction quantity of the cover frame 120 formed of resin is relatively larger than the contraction quantity of the cover plate 110 formed of wood, force is applied to the cover plate 110 due to contraction of the cover frame 120. The above-described contact avoidance part 140 reduces the contact area between the circumferential side 116 of the cover plate 110 and the inner side of the cover frame 120 and alleviates force applied to the cover plate 110 due to contraction of the cover frame 120, thereby preventing the cover plate 110 from being bent or twisted, that is, the shape of the cover plate 110 from being modified.

The resin as the material for the cover frame 120 may be one selected from the group consisting of acrylonitrile-butadiene-styreneresin (ABS), acrylonitrile-styrene (AS), chloroprene-rubber (CR), epoxy resin (EP), ethylene-propyiene-diene-methylene (EPDM), ethylene-tetrafluoro-ethylene (ETFE), ethylene-vinylacetate copolymer (EVA), fiber-reinforced-plastic (FRP), grass-fiber-reinforced-plastic (GRP), melamine-formaldehyde (MF), polyamide (PA), polybutylene-terephthalte (PBT), polycarbonate (PC), polyathylen (PE), highdensity PE (HDPE), lowdensity PE (LDPE), polyathylen terepthalate (PET), polymethacrylate-methyl-acryl (PMMA), polyoxy-methylene (POM), polypropylene (PP), polyphenylene-ether (PPE), polyphenylene-oxide (PPO), polyphenilen-sulfide (PPS), polystyrene (PS), highimpact PS (HIPS), polyvinyl chloride (PVC), and polyvinylidene fluoride (PVDF), and aspects of the present disclosure are not limited thereto.

Hereinafter, a structure of an upper cover 200 according to another embodiment of the present disclosure will be described.

Figure 8:
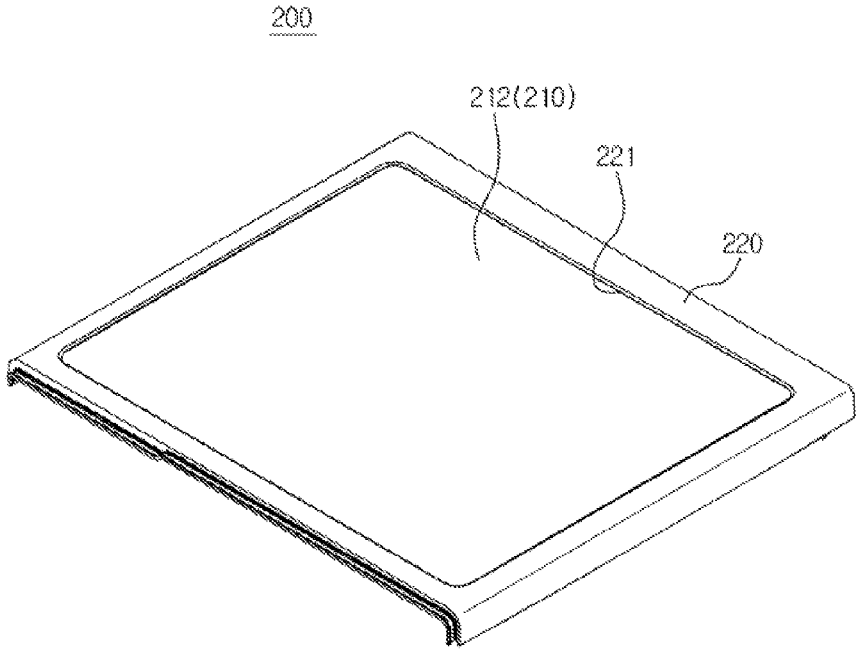
FIG. 8 is a perspective view of an upper cover according to another embodiment of the present disclosure.
Figure 9:
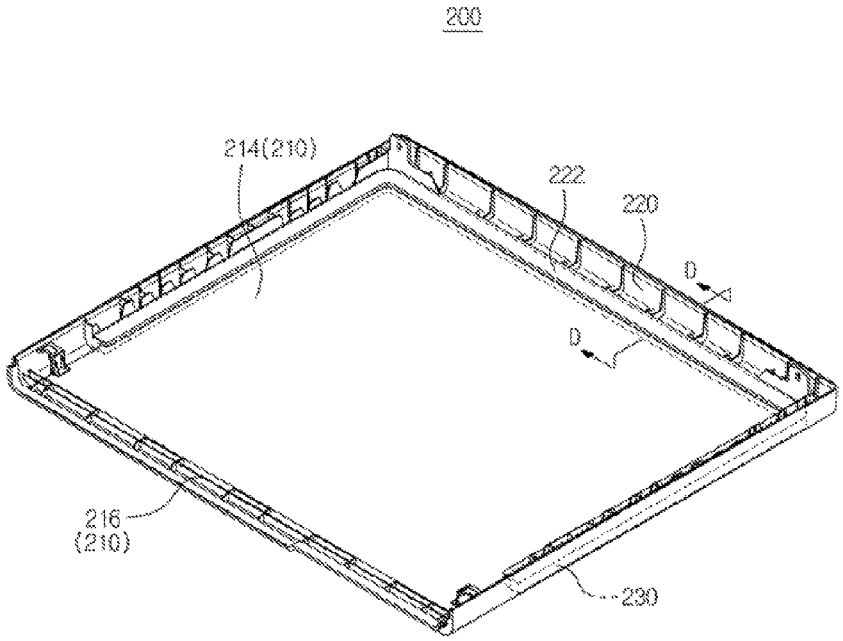
FIG. 9 is a rear perspective view of the upper cover illustrated in FIG. 8.
Figure 10:
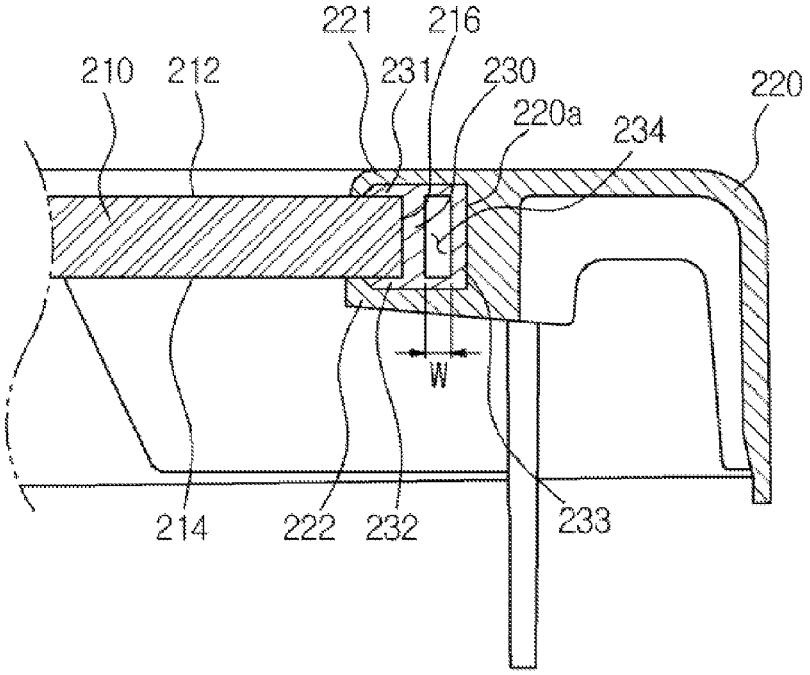
FIG. 10 is a cross-sectional view taken along line D-D of FIG. 9.

FIG. 8 is a perspective view of the upper cover 200 according to another embodiment of the present disclosure, FIG. 9 is a rear perspective view of the upper cover 200 illustrated in FIG. 8, and FIG. 10 is a cross-sectional view taken along line D-D of FIG. 9.

As illustrated in FIGS. 8 through 10, the upper cover 200 includes a cover plate 210 formed in a rectangular shape, a cover frame 220 coupled to the cover plate 210 along a circumference of the cover plate 210, and a damping member 230 disposed between the cover plate 210 and the cover frame 220.

The cover plate 210 is provided as an approximately rectangular plate having an upper side 212, a lower side 214, and a circumferential side 216 that connects the upper side 212 and the lower side 214. The cover plate 210 may be formed of glued laminated wood, compression wood, or synthetic wood so as to have a predetermined strength with light weight.

The cover frame 220 includes at least one first support part 221 that supports the upper side 212 of the cover plate 210 and at least one second support part 222 that supports the lower side 214 of the cover plate 210. The first support part 221 and the second support part 222 may extend along the circumference of the cover plate 210.

The damping member 230 is provided in a space formed by the first support part 221, the second support part 222, and an inner side 220*a* of the cover frame 220 in which the first support part 221 and the second support part 222 extend, and the circumference of the cover plate 210 surrounded by the first support part 221, the second support part 222, and the inner side 220*a* of the cover frame 220.

The damping member 230 includes a first contact part 231, of which an outer side contacts the first support part 221 and an inner side contacts the upper side 212 of the cover plate 210, a second contact part 232, of which an outer side contacts the second support part 222 and an inner side contacts the lower side 214 of the cover plate 210, and a connector 233, of which an inner side contacts the circumferential side 216 of the cover plate 210 and which connects the first contact part 231 and the second contact part 232.

The connector 233 includes a through hole 234 formed by penetrating at least one portion of an inner side of the connector 233 in a lengthwise direction of the damping member 230. The through hole 234 absorbs and alleviates force applied to the cover plate 210 due to contraction of the cover frame 220 when the cover frame 220 is injection molded. A width W of the through hole 234 may be properly adjusted in consideration of the contraction quantity of the cover frame 220 when the cover frame 220 is injection molded.

The damping member 230 may be formed of rubber, silicon, plastic, or a combination thereof so as to sufficiently absorb and alleviate force applied to the cover plate 210 due to contraction of the cover frame 220.

The cover plate 210, the cover frame 220, and the damping member 230 may be manufactured using insert injection molding. That is, the damping member 230 is pre-coupled to the cover plate 210 along the circumference of the cover plate 210, when the cover frame 220 is injection molded, the cover plate 210 to which the damping member 230 is coupled is fixed to a mold for injection molding the cover frame 220, and a resin as a material for the cover frame 220 is injected into the mold and then is hardened, thereby manufacturing the cover plate 210, the cover frame 220, and the damping member 230 integrally with each other.

When the resin as the material for the cover frame 220 is injected into the mold and is hardened, there may be a difference between contraction quantities of the cover plate 210 formed of wood and the cover frame 220 formed of resin. Since the contraction quantity of the cover frame 220 formed of resin is relatively larger than the contraction quantity of the cover plate 210 formed of wood, force is applied to the cover plate 210 due to contraction of the cover frame 220. The damping member 230 absorbs and alleviates force applied to the cover plate 210 due to contraction of the cover frame 220 through modification of the shape of the damping member 230 and modification of the shape of the through hole 234 when the cover frame 220 is contracted, thereby preventing the cover plate 210 from being bent or twisted.

The type of the resin as the material for the cover frame 220 is the same as the cover frame 120 of the upper cover 100 illustrated in FIG. 3 and thus the description thereof will be omitted.

As described above, according to the embodiments of the present disclosure, manufacturing costs for an upper cover of a washing machine may be reduced, and a manufacturing time may be reduced so that productivity of a product can be improved.

Also, a contact area between a cover plate and a cover frame that form the upper cover of the washing machine is reduced, or a damping member is positioned between the cover plate and the cover frame so that the upper cover can be prevented from being bent or twisted in a manufacturing process and the reliability of the product can be improved.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a main body; and an upper cover configured to cover an upper part of the main body, wherein the upper cover comprises:

a cover plate formed in a rectangular shape; and a cover frame formed of a material different from a material for the cover plate and coupled to the cover plate along a perimeter of the cover plate, wherein the cover frame comprises:

a first support part configured to support an upper side of the cover plate;

a second support part configured to support a lower side of the cover plate;

a plurality of third support parts configured to extend from an inner side of the cover frame facing a perimeter side of the cover plate toward the perimeter side of the cover plate, and contact the perimeter side of the cover plate; and a contact avoidance part configured not to contact the perimeter side of the cover plate and form a space between the cover plate and the cover frame, wherein at least two third support parts among the plurality of third support parts are spaced apart from each other by a gap along an inner perimeter of the cover frame to support the perimeter side of the cover plate, and the contact avoidance part is disposed between the plurality of third support parts.

2. The washing machine according to claim 1, wherein the plurality of third support parts and the contact avoidance part are alternatively disposed in the cover frame.

3. A washing machine comprising:

a main body; and an upper cover configured to cover an upper part of the main body, wherein the upper cover comprises:

a cover plate formed in a rectangular shape; and a cover frame formed of a material different from a material for the cover plate and coupled to the cover plate along a perimeter of the cover plate, wherein the cover frame comprises:

a first support part configured to support an upper side of the cover plate;

a second support part configured to support a lower side of the cover plate;

a plurality of third support parts spaced apart from each other by a gap along an inner perimeter of the cover frame, and configured to extend from an inner side of the cover frame facing a perimeter side of the cover plate toward the perimeter side of the cover plate, and contact the perimeter side of the cover plate to support the perimeter side of the cover plate; and a contact avoidance part disposed between at least two third support parts among the plurality of third support parts, and configured not to contact the perimeter side of the cover plate and form a space between the cover plate and the cover frame.

4. The washing machine according to claim 3, wherein the cover plate is inserted when the cover frame is injection molded and is formed integrally with the cover frame.

5. The washing machine according to claim 3, wherein the contact avoidance part comprises:

a plurality of contact avoidance parts, wherein at least two contact avoidance parts among the plurality of contact avoidance parts are spaced apart from each other by the gap along the inner perimeter of the cover frame.

6. The washing machine according to claim 3, wherein the plurality of third support parts and the contact avoidance part are alternatively disposed in the cover frame.

7. A washing machine comprising:

a main body of which an upper part is open; and a cover member coupled to the upper part of the main body, wherein the cover member comprises:

a cover plate formed in a rectangular shape; and a cover frame coupled to the cover plate along a perimeter of the cover plate, wherein the cover frame comprises:

a plurality of support ribs configured to extend from an inner side of the cover frame facing a perimeter side of the cover plate toward the perimeter side of the cover plate, and contact the perimeter side of the cover plate; and a plurality of contact avoidance sides disposed between two adjacent support ribs provided on a single perimeter side of the cover plate among the plurality of support ribs and configured not to contact the perimeter side of the cover plate and form a space between the cover plate and the cover frame.

8. The washing machine according to claim 7, wherein the plurality of support ribs comprise:

a first contact side that contacts the perimeter side; and a second contact side that contacts a lower side of the cover plate connected to the perimeter side.

9. The washing machine according to claim 7, wherein the plurality of support ribs are configured in such a way that at least two support ribs among the plurality of support ribs are spaced apart from each other by a predetermined gap along an inner side of the cover frame.

10. The washing machine according to claim 7, further comprising a strength reinforcement rib configured to connect the inner side of the cover frame and the plurality of support ribs to reinforce strength of the plurality of support ribs.

11. The washing machine according to claim 7, wherein the cover plate is inserted when the cover frame is injection molded.

12. The washing machine according to claim 7, wherein the plurality of support ribs and the plurality of contact avoidance sides are alternatively disposed in the cover frame.

* * * * *